US008147763B2

(12) United States Patent
Maus

(10) Patent No.: US 8,147,763 B2
(45) Date of Patent: Apr. 3, 2012

(54) HONEYCOMB BODY HAVING A CONTRACTION LIMITER

(75) Inventor: Wolfgang Maus, Bergisch Gladbach (DE)

(73) Assignee: EMITEC Gesellschaft fuer Emissionstechnologie mbH, Lohmar (DE)

( * ) Notice: Subject to any disclaimer, the term of this patent is extended or adjusted under 35 U.S.C. 154(b) by 1786 days.

(21) Appl. No.: 10/763,027

(22) Filed: Jan. 21, 2004

(65) Prior Publication Data

US 2004/0152595 A1 Aug. 5, 2004

Related U.S. Application Data

(63) Continuation of application No. PCT/EP02/08286, filed on Jul. 25, 2002.

(30) Foreign Application Priority Data

Aug. 2, 2001 (DE) ..... 101 37 897

(51) Int. Cl.

| | |
|---|---|
| ***B01D 50/00*** | (2006.01) |
| ***B01D 53/34*** | (2006.01) |
| ***B01J 8/02*** | (2006.01) |
| ***B01J 35/02*** | (2006.01) |

(52) U.S. Cl. ..... 422/180; 422/168; 422/211; 422/221

(58) Field of Classification Search ..... 422/180
See application file for complete search history.

(56) References Cited

U.S. PATENT DOCUMENTS

| | | | | |
|---|---|---|---|---|
| 4,142,864 | A | 3/1979 | Rosynsky et al. | 422/179 |
| 4,193,793 | A * | 3/1980 | Cheung | 75/235 |
| 4,795,615 | A * | 1/1989 | Cyron et al. | 422/179 |
| 5,079,210 | A | 1/1992 | Kaji et al. | 502/439 |
| 5,486,338 | A * | 1/1996 | Ota et al. | 422/179 |
| 5,614,155 | A | 3/1997 | Abe et al. | |
| 5,916,530 | A * | 6/1999 | Maus et al. | 422/179 |
| 6,245,301 | B1 * | 6/2001 | Stroom et al. | 422/179 |
| 6,738,455 | B1 | 5/2004 | Miyagawa | |

FOREIGN PATENT DOCUMENTS

| | | |
|---|---|---|
| DE | 38 17 490 C2 | 11/1989 |
| DE | 39 26 072 C2 | 2/1991 |
| DE | 39 30 680 A1 | 3/1991 |
| DE | 43 03 950 C1 | 10/1994 |

(Continued)

OTHER PUBLICATIONS

MatWeb (Material physical property website) http://www.matweb.com/search/DataSheet.aspx?MatGUID=Ocf4755fe3094810963eaa74fe812895&ckck=1 (Nov. 4, 2009).*

*Primary Examiner* — Matthew Merkling
(74) *Attorney, Agent, or Firm* — Laurence A. Greenberg; Werner H. Stemer; Ralph E. Locher

(57) ABSTRACT

Honeycomb bodies, especially those used in an exhaust system of an internal combustion engine, contain a housing and a metal matrix with an average starting diameter. The matrix is connected to the housing, whereby at least one contraction limiter that causes an outward directed tensile stress in at least one part of the matrix is provided. The average starting diameter of the matrix is reduced by 5%, preferably by a maximum of 2%, during and/or after being subjected to thermal stress.

28 Claims, 3 Drawing Sheets

FOREIGN PATENT DOCUMENTS

| | | | |
|---|---|---|---|
| EP | 0 687 807 | A1 | 12/1995 |
| JP | 53-147676 | | 12/1978 |
| JP | 1-54090 | | 11/1989 |
| JP | 02 298 620 | | 12/1990 |
| JP | 03157139 | A | 7/1991 |
| JP | 6-106073 | | 4/1994 |
| JP | 08004521 | A | 1/1996 |
| JP | 08294632 | A | 11/1996 |
| JP | 09317456 | | 12/1997 |
| JP | 10000337 | | 1/1998 |
| JP | 19990044011 | A | 6/1999 |

* cited by examiner

HONEYCOMB BODY HAVING A CONTRACTION LIMITER

CROSS REFERENCE TO RELATED APPLICATION

This application is a continuation of International Application No. PCT/EP02/08286, filed Jul. 25, 2002, which designated the United States and was not published in English.

BACKGROUND OF THE INVENTION

Field of the Invention

The invention is concerned with a honeycomb body, in particular for use in an exhaust system in an internal combustion engine, which body contains a housing and a matrix, in particular a metallic matrix, having an average initial diameter. Honeycomb bodies of this type serve, in particular, as catalyst carrier bodies for cleaning exhaust gases of a diesel engine or spark-ignition engine.

It is known that the metallic honeycomb bodies in exhaust systems of internal combustion engines are exposed to a high, thermal alternating stresses. As a consequence of the thermal stress and the generally unequal configuration of the housing and of the matrix in respect of their surface-specific heat capacity, the expansion behavior of the housing and matrix differ. The resulting relative movement of the matrix in the radial and in the axial direction relative to the housing has resulted in a multiplicity of different concepts relating to the permanent fastening of the matrix to the housing already being known.

One known possibility for fastening the matrix to the housing is described, for example, in U.S. Pat. No. 5,079,210. The cited patent specification is concerned with a metallic honeycomb body formed of corrugated and smooth sheet-metal layers, the body being connected to the housing via an intermediate sleeve. In this case, the connection of the sheet-metal layers to the housing is configured in such a manner that the intermediate sleeve is connected at an end region to the sheet-metal layers and at the opposite end region to the housing. The intermediate sleeve has a plurality of flexible subregions, so that the intermediate sleeve can follow the contraction and expansion behavior of the metallic matrix. The separation of the flexible subregions by slots that extend in the axial direction also permits compensation of the shrinkage and expansion of the matrix in the circumferential direction. The matrix has, in addition, the possibility of freely expanding and contracting in the axial direction. Consequently, the different thermal expansion behaviors of the housing and matrix are compensated for by a flexible deformation of the intermediate sleeve, so that no thermal stresses are initiated in the housing by the matrix.

However, tests have shown that because of the different cooling behavior in edge regions and in core regions of the matrix, after repeated thermal alternating stresses known metallic honeycomb bodies no longer assume their original, in particular cylindrical shape, but rather reduce their volume and have a contour similar to a barrel. This has the effect, for example, that a relatively large annular gap is formed between the matrix and the housing, through which, in particular during operation of the honeycomb body in the exhaust system of an internal combustion engine, the uncleaned exhaust gas flows and, in consequence, effective cleaning in accordance with legal regulations cannot be ensured.

SUMMARY OF THE INVENTION

It is accordingly an object of the invention to provide a honeycomb body having a contraction limiter that overcomes the above-mentioned disadvantages of the prior art devices of this general type, which ensures an effective conversion of pollutants in the exhaust gas even after the honeycomb body has been subjected to a multiplicity of thermal alternating stresses. Furthermore, the honeycomb body is intended to have a significantly improved service life, in particular with regard to the fastening of the matrix to the housing.

With the foregoing and other objects in view there is provided, in accordance with the invention, a honeycomb body. The honeycomb body contains a housing, a matrix having an average initial diameter and connected to the housing, and at least one contraction limiter causing an outwardly directed tensile stress in at least one part of the matrix, so that the average initial diameter of the matrix decreases by at most 5% during and/or after a thermal stress.

The honeycomb body according to the invention is distinguished by the fact that the matrix has at least one contraction limiter which causes an outwardly directed tensile stress on at least one part of the matrix, so that the average initial diameter of the matrix decreases by at most 5%, preferably even only by at most 2%, during and/or after a thermal stress. Within the context of the invention, an average outside diameter is to be understood to be at least a value that is averaged over the circumference of the matrix.

A contraction limiter in this context is a component of the honeycomb body which keeps at least part of the matrix under stress if the latter attempts to contract as a consequence of being subjected to a thermal alternating stress. However, a contraction limiter to a certain extent also permits an expansion and/or contraction of the matrix, and accordingly does not obstruct these processes as severely as the housing, which is essentially rigid or much more indifferent with regard to the thermal expansion behavior relative to the matrix. For example, a contraction limiter is configured in such a manner that, in comparison with the housing, it can absorb only a predeterminable portion of the stresses occurring in the radial direction before the contraction limiter follows the expansion and contraction behavior of the matrix. The portion of the radial stresses lies preferably between 20% and 80%, in particular between 35% and 70%. However, it is also possible for the contraction limiter to have a predeterminable thermal expansion behavior that is displaced in terms of time or in relation to temperature in comparison with the matrix. Therefore, for example, the contraction limiter begins to deform only in a higher temperature range in comparison with the matrix and already begins to deform in a lower temperature range in comparison with the housing. In this case, the surface-specific heat capacity is also of importance, so that it is advantageous under some circumstances for the surface-specific heat capacity of the contraction limiter to be placed in a region lying between the surface-specific heat capacity of the matrix and that of the housing. The different thermal expansion and contraction behavior of the matrix and the housing ensures, on the one hand, that the thermal behavior of the matrix is influenced positively, in particular is slowed down, in the above-described manner while at the same time too rigid a casing around the matrix is avoided.

It should be noted with regard to an axial reference to the outside diameter that the average outside diameter is to be determined, in particular, close to the region in which the tensile stress is introduced into the matrix. The contraction limiter can be configured, for example, as a separate component in or around the region in which a tensile stress is to be introduced into the matrix. The effect of this during the thermal stress is that the dimensions of the matrix are changed only to a very limited extent, in which case, in particular, the connecting device serving to fix the matrix in the housing are relieved of load. If the connecting device is disposed, for example, relatively close to the contraction limiter, in particular within a distance of 1 mm to 10 mm, then the matrix remains in a virtually unchanged position relative to the housing in spite of the thermal stresses. In this refinement, the connecting device can be of relatively rigid construction.

However, it is also advantageous, under some circumstances, that the contraction limiter itself is part of the connection of the matrix to the housing. In contrast to the known, flexible connecting elements between the matrix and housing, the connecting elements permitting an unobstructed relative movement of the matrix relative to the housing, it is proposed according to the invention to influence contraction behavior of the matrix in a specific manner such that the outer shape of the honeycomb body, in particular of the matrix, is kept essentially constant over a multiplicity of thermal alternating stresses. In this case, a maximum permitted shrinkage of the average initial diameter by at most 5% ensures, on the one hand, that account is taken of the different thermal expansion behavior of the matrix and housing and, on the other hand, the matrix is "fanned out" as far as possible by the contraction limiter, so that the matrix fills virtually the entire cross section of the housing. The cavities of the matrix are consequently opened wide, with only a very small drop in pressure of a gas flow flowing through the honeycomb body being detectable.

According to a further refinement of the honeycomb body, the contraction limiter is connected with an end region to the matrix, a connecting region being formed, and is connected with an end region to the housing, a fastening region being formed. Such a refinement of the connection ensures, in particular, a free, axial expansion and contraction behavior of the matrix. In this case, the connecting region is preferably an encircling configuration in the circumferential direction of the matrix, thus ensuring that the tensile stress is initiated as homogeneously as possible into the matrix. Stress peaks that could impair the structural integrity of the matrix are therefore avoided.

If the contraction limiter and the matrix have a common connecting region, and if the matrix has walls which are connected to one another by a joining technique, then, according to yet another refinement of the honeycomb body, the tensile stress applied via the connecting region corresponds at most to an average strength of the joining connections of the walls to one another and/or to an average strength of the walls themselves. Average strength in this case is an averaged value based on the individual connecting points of the adjacent walls of the matrix and the tensile strength of the material of the walls themselves.

The limitation of the tensile stress applied by the contraction limiter ensures that neither the joining connections themselves nor the wall are destroyed. Since the tensile stress is directed, in particular, outward or radially outward, the corresponding strength of the connection or of the walls in this direction is also to the fore in this connection.

Care should also be taken, with regard to the configuration of the contraction limiter, to ensure that the average strength of the joining connections or of the walls are temperature-dependent, in which case, even if there is a temperature-related drop in the average strength of the joining connections or of the walls, the lower strength in each case (connection or walls) has to be greater than the tensile stress which is applied.

According to yet another refinement of the honeycomb body, the tensile stress produced by the contraction limiter is effective in a temperature range of from −40° C. to 1050° C. The temperature range encompasses the temperatures occurring in the use of a honeycomb body of this type. In this manner, the presence of the tensile stress and therefore the limited contraction behavior are always ensured. In this context, in addition to the contraction of the honeycomb body in the region of very cold temperatures, in particular below 0° C. and, in particular, below −20° C., the temperature range of between 600° C. and 1050° C. also plays an important role. The temperature range has a substantial significance in respect of the contraction and expansion behavior of the metallic matrix after or during a thermal stress of the matrix by a hot exhaust gas. In the temperature range, in particular at a high speed of change of the temperature, such as, for example, in the cold start phase or directly after the internal combustion engine is switched off, particularly large differences in respect of the thermal expansion behavior of the matrix and housing are produced, and so it is precisely in this temperature range that the contraction of the honeycomb body is to be obstructed. In this connection, the matrix, the contraction limiter and the housing can be disposed with respect to one another, at least in subregions, in such a manner that the matrix bears against the housing directly via the contraction limiter, in which case a significantly lower tensile stress or even a compressive stress is partially brought about in the matrix at temperatures below 600° C. by the housing.

According to yet another refinement, the connecting region is disposed close to an end side, preferably within a distance from the end side in the direction of an axis of less than 20 mm, in particular even of less than 10 mm. If, for example, the use of a honeycomb body of this type in an exhaust system of an internal combustion engine is considered, then very large thermal alternating stresses are present precisely in the region of the gas inlet side and of the gas outlet side, i.e. in the region of the end sides. Since, in addition, very large fluctuations of pressure occur in an exhaust gas flow of this type, it is particularly the region of the matrix close to the gas inlet side that is severely stressed, also in a dynamic respect. The configuration of the connecting region close to the gas inlet side therefore also supports the structural integrity in this region. Furthermore, the gas inlet side and/or the gas outlet side may, if appropriate, thus also be used as a fixed reference point of the honeycomb body in the exhaust system, since, given a connection of this type, an expansion or contraction of the honeycomb body in the axial direction results essentially only in a relative movement of the gas inlet side and/or gas outlet side.

According to yet another refinement of the honeycomb body, the at least one contraction limiter is configured in such a manner that it seals an annular gap surrounding the matrix. This ensures that, for example, an exhaust gas that is to be cleaned cannot flow past the matrix, but rather the entire exhaust gas flow is guided through the matrix and is catalytically converted.

According to yet another refinement, a plurality of contraction limiters are disposed axially one behind another, an arrangement offset with respect to one another in the direction of a circumference of the matrix being preferred. In particular, a plurality of contraction limiters are configured such that they are flexible in the direction of the axis to allow the free, axial contraction and expansion of the matrix. Such a refinement of the honeycomb body is appropriate, in particular, if the matrix has a ratio of initial diameter to axial length that is greater than two. In such embodiments, which are similar to a cigar, of honeycomb bodies, a plurality of contraction limiters are connected one behind another to provide a permanent fastening of the matrix to the housing. The contraction limiters do not obstruct the expansion and contraction behavior of the matrix in the radial direction nor in the axial direction.

According to yet another refinement of the honeycomb body, the at least one contraction limiter and the matrix are formed of different material. In this case, it is preferable for the contraction limiter and the matrix to be configured with different coefficients of thermal expansion. This is of importance, inter alia, since the maximum tensile stress to be applied is highly temperature-dependent, and a skillful selection of material and coefficients of thermal expansion of the contraction limiter and of the matrix makes it possible for a predeterminable tensile stress varying, in particular, as a function of temperature to be introduced in different temperature ranges in each case.

According to yet another refinement of the honeycomb body, the matrix is thermally insulated relative to the housing. This has the advantage of suppressing a heat exchange between the matrix and housing, so that the contraction limiter does not constitute a heat source or heat sink in respect of the thermal expansion behavior of the matrix and housing.

According to yet another refinement of the honeycomb body, the walls of the matrix contain at least partially structured (corrugated) sheet-metal foils which are stacked and/or coiled in such a manner that they form channels through which a gas can flow. In particular, a spiral, s-shaped or involute-shaped configuration of the sheet-metal foils is preferred. In this case, the sheet-metal foils preferably have a thickness of less than 0.06 mm, in particular even of less than 0.03 mm. It is particularly advantageous for the matrix to have a channel density of greater than 600 cells per square inch (CPSI), in particular of greater than 1000 CPSI. In respect of the use of a honeycomb body of this type in an exhaust system of an internal combustion engine, a catalytically active coating of the honeycomb body is advantageous in order to be able to ensure an effective conversion of pollutants in the exhaust gas at relatively low temperatures.

According to yet another refinement, the matrix is at least partially surrounded by an outer structured foil that, in particular, at least partially forms the contraction limiter. The structured (corrugated) foil offers the advantage here that it constitutes an, if appropriate, encircling, single-piece contraction limiter, with a certain flexibility in the circumferential direction being ensured at the same time because of its structured nature.

According to yet another refinement, it is proposed that the contraction limiter has measures for preventing crack propagation. Measures of this type are, for example, accumulations of material, transverse webs, transverse slots or the like which prevent thermally or mechanically induced cracking from propagating unimpeded through the contraction limiter.

Other features which are considered as characteristic for the invention are set forth in the appended claims.

Although the invention is illustrated and described herein as embodied in a honeycomb body having a contraction limiter, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
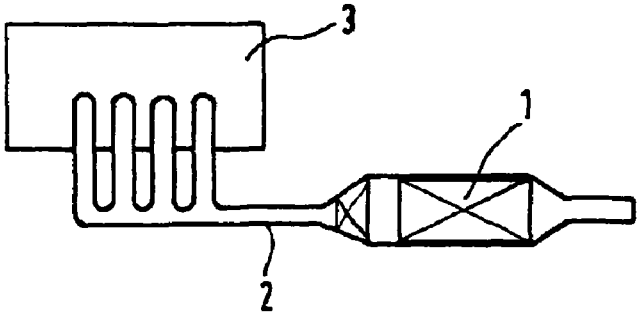
FIG. 1 is an illustration of an exhaust system with an internal combustion engine and a honeycomb body.

Referring now to the figures of the drawing in detail and first, particularly, to FIG. 1 thereof, there is shown schematically, the construction of an exhaust system 2 for cleaning exhaust gas which is produced in an internal combustion engine 3. For conversion of the pollutants contained in the exhaust gas, the exhaust system 2 has a plurality of components, such as, for example, particle traps, electric heating elements or else a honeycomb body 1.

Figure 2:
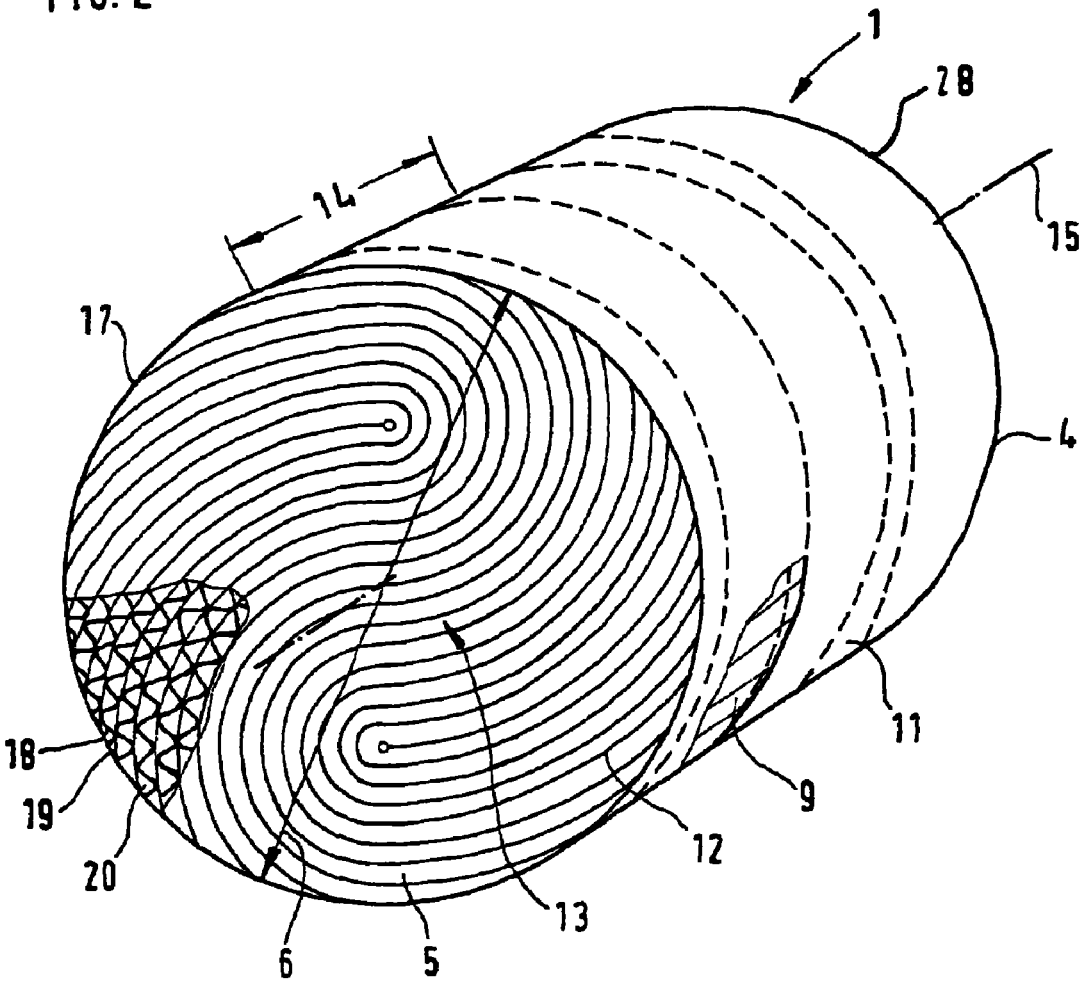
FIG. 2 is a diagrammatic, perspective view of the honeycomb body according to the invention.

FIG. 2 shows, schematically and perspectively, an embodiment of the honeycomb body 1 that is suitable, in particular, for use in the exhaust system 2 of the internal combustion engine 3. The honeycomb body 1 contains a housing 4 and a metallic matrix 5 having an average initial diameter 6. The matrix 5 is connected to the housing 4 via at least one contraction limiter 7 (see FIG. 3). The contraction limiter 7 causes an outwardly directed tensile stress in the matrix 5, so that the average initial diameter 6 of the matrix 5 shrinks by at most 5%, preferably even only by at most 2%, during and/or after a thermal stress.

In this case, the at least one contraction limiter 7 is connected with an end region 8 to the matrix 5, a connecting region 9 being formed. With an end region 10 the at least one contraction limiter 7 is connected to the housing 4 and therefore forms a fastening region 11. The connecting region 9 is disposed close to a gas inlet side within a distance 14 (FIG. 2) from a gas-inlet-side end side 13 in the direction of an axis 15 of smaller than 20 mm. It would furthermore likewise be possible, according to the invention, to form the connecting region 9 close to a gas-outlet-side end side 28.

The matrix 5 of the honeycomb body 1 has walls 12 which contain at least partially structured (corrugated) sheet-metal foils 18 and 19 which are stacked and/or coiled in such a manner that they form channels 20 through which a gas can flow. The illustrated embodiment of the honeycomb body 1 shows an s-shaped configuration of the sheet-metal foils 18 and 19, the latter ending in each case on a circumference 17 of the honeycomb body 1.

Figure 3:
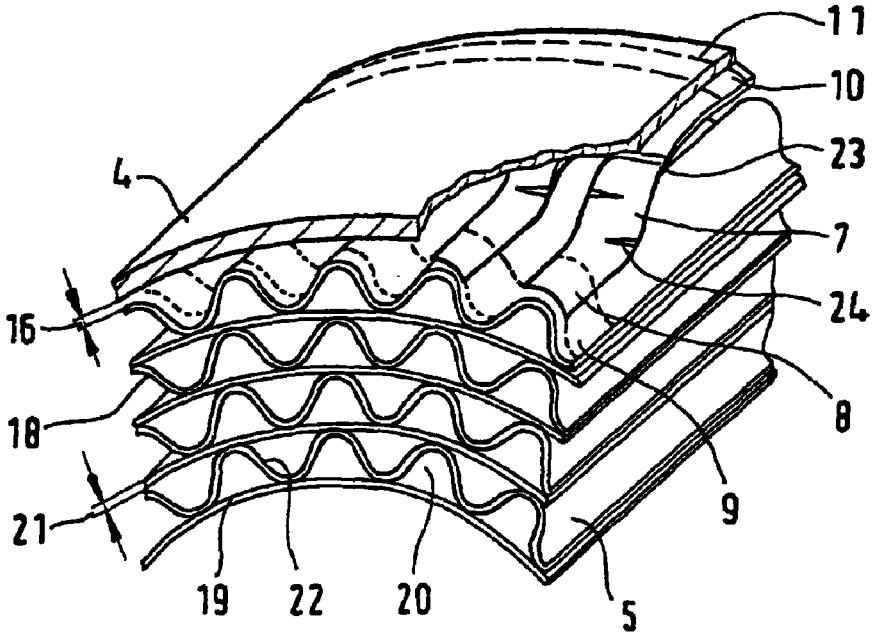
FIG. 3 is a perspective view of a further embodiment of the honeycomb body.

FIG. 3 shows, schematically and in a view of a detail, a subregion of the matrix 5 and of the housing 4, the matrix 5 being connected to the housing 4 via a plurality of the contraction limiters 7. The contraction limiters 7 cause a tensile stress, which is outwardly directed, i.e. is directed toward the housing 4, in the matrix 5, so that the average initial diameter 6 of the matrix 5 shrinks by at most 5%, preferably even only by at most 2%, during and/or after a thermal stress.

The contraction limiters 7 are connected with the end region 8 to the matrix 5, the connecting region 9 being formed, and are connected with the end region 10 to the housing 4, the fastening region 11 being formed. In this case, the tensile stress applied via the connecting region 9 corresponds at most to an average strength of the joining connections of the walls 12 to one another and/or to an average strength of the walls 12 themselves.

The walls 12 are formed here with structured (corrugated) foils 18 and smooth foils 19, thus forming the channels 20 through which a gas can flow. The sheet-metal foils 18 and 19 have a thickness 21 of less than 0.06 mm. In respect of the use of a honeycomb body 1 of this type in the exhaust system 2 of the internal combustion engine 3, the channel density of the matrix 5 is at least 600 cells per square inch (CPSI), the sheet-metal foils 18, 19 being provided with a catalytically active coating 22 for the conversion of pollutants contained in the exhaust gas.

The contraction limiter 7 that is illustrated has for example, transverse webs 23 and transverse slots 24 for preventing crack propagation. This prevents a crack from expanding from the connecting region 9 as far as the fastening region 11. The configuration of the contraction limiters 7 between the housing 4 and the matrix 5 results in the formation of an annular gap 16 which is advantageously sealed by the contraction limiter 7. The annular gap 16 is relatively small, since usually directly after production the matrix 5 bears with suction against the housing 4 and the shrinkage of the average initial parameter 6 of the matrix 5 shrinks, according to the invention, by at most 5% during and/or after a thermal stress.

Figure 4:
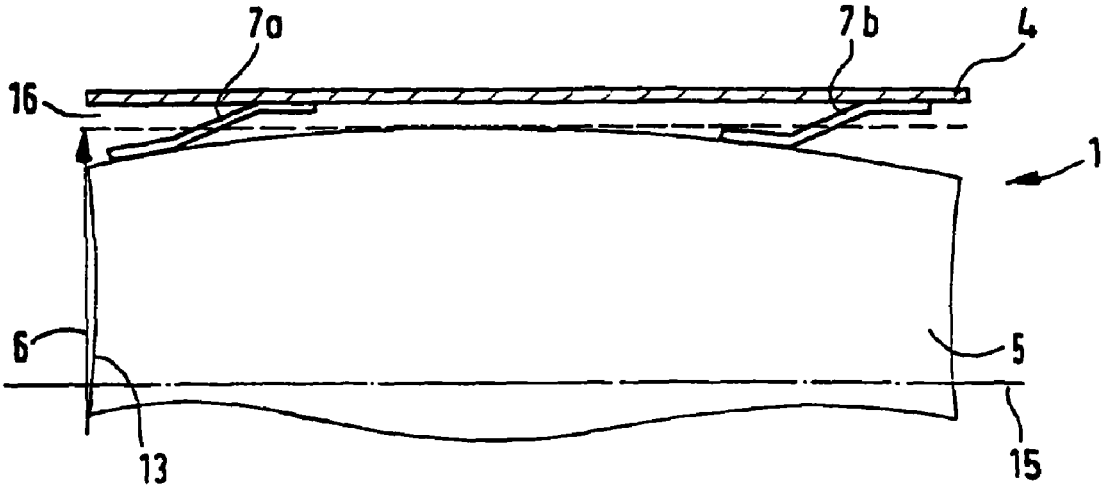
FIG. 4 is a sectional view of a further embodiment of the honeycomb body.

FIG. 4 shows, schematically, a further embodiment of the honeycomb body 1 according to the invention. In this case, the matrix 5 is connected to the housing 4 via a plurality of contraction limiters 7*a* and 7*b*, the connecting region 9 being formed in each case between one of the contraction limiters 7*a*, 7*b* and the matrix 5, and the fastening region 11 being formed between one of the contraction limiters 7*a*, 7*b* in each case and the housing 4. The contraction limiters 7*a*, 7*b* cause an outwardly directed tensile stress in the matrix, so that the average initial diameter 6 of the matrix 5 shrinks by at most 5% during and/or after a thermal stress. The contraction limiters 7*a* and 7*b* are disposed axially 15 one behind the other, a configuration offset with respect to one another in the direction of the circumference 17 of the matrix 5 being preferred. The contraction limiters 7*a*, 7*b* are configured such that they are flexible in the direction of the axis 15 to allow the free, axial contraction and expansion of the matrix 5.

The external configuration of the matrix 5 is illustrated here in the manner in which it customarily appears after a plurality of thermal alternating stresses. While the dashed line, to which the average initial diameter 6 extends, indicates the original shape (cylinder shape), the matrix 5 is now in the shape of a barrel. However, the contraction limiters 7*a* and 7*b* ensure that the annular gap 16 remains very small, since a maximum shrinkage of the average initial diameter 6 of 5% is permitted, in particular close to the gas-inlet-side end side 13 or the gas-outlet-side end side 28.

Figure 5:
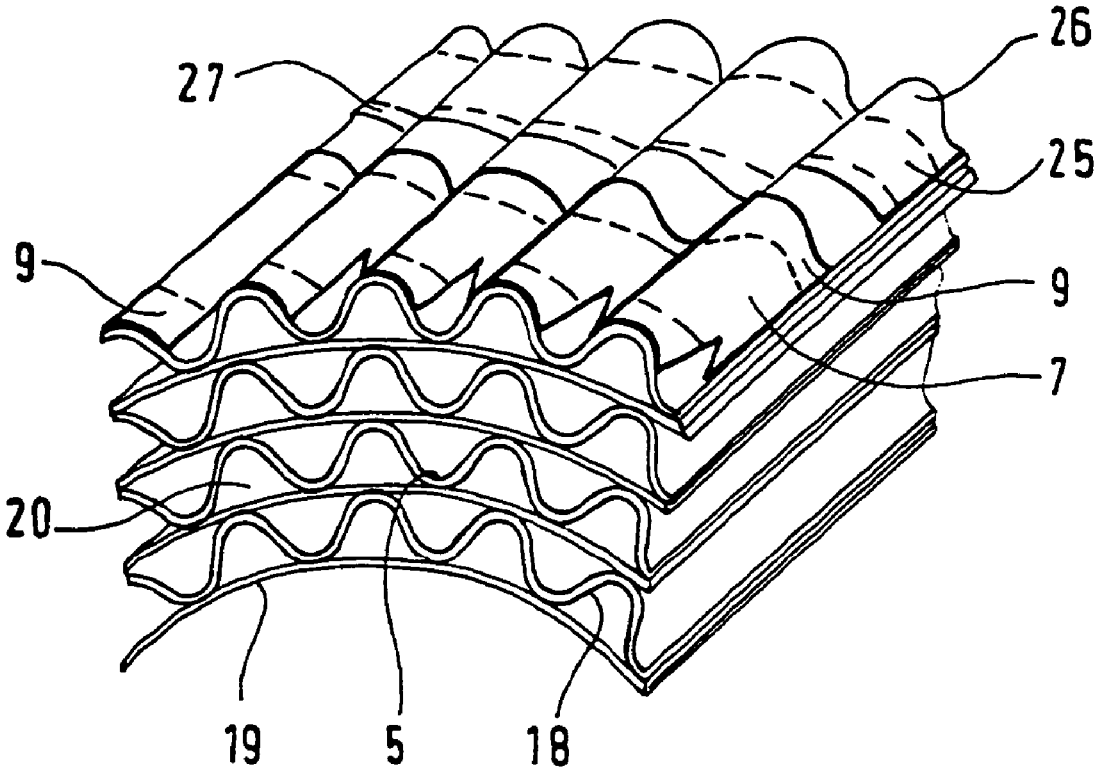
FIG. 5 is a perspective view of a detail of the further embodiment of the honeycomb body.

FIG. 5 shows, schematically and perspectively, a view of a detail of a further embodiment of the honeycomb body. In this case, the matrix 5 is again formed with smooth foils 19 and structured foils 18 in such a manner that channels 20 through which a fluid can flow are formed. In the embodiment illustrated, the matrix 5 is surrounded by the contraction limiter 7, the latter being connected to the matrix 5 via two connecting regions 9. The contraction limiter 7 causes an outwardly directed tensile stress in at least one part of the matrix 5, so that the average initial diameter 6 of the matrix 5 decreases by at most 5% during and/or after a thermal stress. In this case, the matrix 5 is fixed to the housing 4 by at least one fastening device 25, which is connected to the housing 4 via a first fastening 26 and to the matrix 5 by a second fastening 27. Since a substantial decrease in the outside diameter 6 is avoided by the contraction limiter 7, the matrix 5 can be fixed by the relatively stable fastening device 25, in particular if the second fastening 27 is disposed close to the contraction limiter 7.

I claim:

1. A honeycomb body, comprising:

a housing;

a matrix having an average initial diameter and connected to said housing; and at least one contraction limiter configured for imparting an outwardly directed tensile stress in at least one part of said matrix for preventing the average initial diameter of said matrix from decreasing by more than 5% after repeated thermal alternating stresses in the range between 600° C. and 1050° C.

2. The honeycomb body according to claim 1, wherein said matrix is connected to said housing by said at least one contraction limiter.

3. The honeycomb body according to claim 1, wherein said at least one contraction limiter has a first end region connected to said matrix resulting in a formation of a connecting region, and a second end region connected to said housing resulting in a formation of a fastening region.

4. The honeycomb body according to claim 1, wherein:

said at least one contraction limiter and said matrix have a common connecting region; and said matrix has walls connected to one another by joining connections, the tensile stress being applied through said common connecting region and corresponding at most to an average strength of said joining connections of said walls to one another and/or to an average strength of said walls themselves.

5. The honeycomb body according to claim 1, wherein said at least one contraction limiter and said matrix have a common connecting region, said common connecting region is disposed close to an end side of said matrix.

6. The honeycomb body according to claim 1, wherein said matrix and said housing define an annular gap therebetween and surrounding said matrix, and said at least one contraction limiter seals said annular gap surrounding said matrix.

7. The honeycomb body according to claim 1, wherein:

said matrix has a circumference; and said contraction limiter is one of a plurality of contraction limiters disposed axially one behind another, with an offset with respect to one another in a direction of said circumference of said matrix.

8. The honeycomb body according to claim 1, wherein said at least one contraction limiter and said matrix are formed from different materials.

9. The honeycomb body according to claim 1, wherein said matrix is thermally insulated with respect to said housing.

10. The honeycomb body according to claim 1, wherein said at least one contraction limiter has a coefficient of thermal expansion which is different from said matrix.

11. The honeycomb body according to claim 1, wherein said matrix has walls formed of at least partially structured sheet-metal foils stacked and/or coiled forming channels through which a gas can flow.

12. The honeycomb body according to claim 11, wherein said matrix is at least partially surrounded by an outer structured foil.

13. The honeycomb body according to claim 11, wherein said sheet-metal foils have a thickness of less than 0.06 mm.

14. The honeycomb body according to claim 11, wherein said matrix has a channel density greater than 600 cells per square inch.

15. The honeycomb body according to claim 1, further comprising a catalytically active coating disposed on said matrix.

16. The honeycomb body according to claim 1, wherein said at least one contraction limiter has means for preventing crack propagation.

17. The honeycomb body according to claim 11, wherein said sheet-metal foils have a thickness of less than 0.03 mm.

18. The honeycomb body according to claim 11, wherein said matrix has a channel density greater than 1000 cells per square inch.

19. The honeycomb body according to claim 11, wherein said matrix is at least partially surrounded by an outer structured foil that at least partially forms said at least one contraction limiter.

20. The honeycomb body according to claim 5, wherein said common connecting region is disposed a distance to said end side of said matrix in a direction of an axis of said matrix.

21. The honeycomb body according to claim 20, wherein said distance to said end side is less than 20 mm.

22. The honeycomb body according to claim 20, wherein said distance to said end side is less than 10 mm.

23. The honeycomb body according to claim 7, wherein said plurality of contraction limiters are flexible in a direction of an axis of said matrix for allowing a free axial contraction and expansion of said matrix.

24. The honeycomb body according to claim 1, wherein the honeycomb body is used in an exhaust system of an internal combustion engine.

25. The honeycomb body according to claim 1, wherein said matrix is a metallic matrix.

26. The honeycomb body according to claim 1, wherein the average initial diameter of said matrix decreases by at most 2% during and/or after the thermal stress.

27. The honeycomb body according to claim 1, wherein said at least one contraction limiter is a single-piece corrugated foil encircling said matrix.

28. The honeycomb body according to claim 1, wherein said at least one contraction limiter is affixed to said matrix at a vicinity of a longitudinal end of said matrix.

* * * * *